US006446757B1

(12) United States Patent
Taylor

(10) Patent No.: US 6,446,757 B1
(45) Date of Patent: Sep. 10, 2002

(54) LOCK MECHANISM FOR LIFT

(75) Inventor: Bryan D. Taylor, Madison, IN (US)

(73) Assignee: Delaware Capital Formation, Inc., Wilmington, DE (US)

( * ) Notice: Subject to any disclaimer, the term of this patent is extended or adjusted under 35 U.S.C. 154(b) by 29 days.

(21) Appl. No.: 09/665,376

(22) Filed: Sep. 20, 2000

Related U.S. Application Data

(60) Provisional application No. 60/175,470, filed on Jan. 11, 2000.

(51) Int. Cl.[7] ..... B66F 7/02; B66F 17/00

(52) U.S. Cl. ..... 187/208; 187/207; 187/213; 187/252; 187/361; 254/98

(58) Field of Search ..... 187/206–209, 187/213, 351, 352, 361, 363, 364, 365; 254/98

(56) References Cited

U.S. PATENT DOCUMENTS

| | | | | | |
|---|---|---|---|---|---|
| 579,797 | A | | 3/1897 | Gray | |
| 743,258 | A | | 11/1903 | Dolbey | |
| 886,026 | A | | 4/1908 | Wisniewski et al. | |
| 889,833 | A | | 6/1908 | Wallingford | |
| 1,084,505 | A | | 1/1914 | Thorson | |
| 2,266,915 | A | | 12/1941 | Steedman | |
| 2,564,267 | A | | 8/1951 | Manke | |
| 2,843,223 | A | * | 7/1958 | Villars | 187/209 |
| 3,291,260 | A | * | 12/1966 | Woor et al. | 187/209 |
| 4,015,686 | A | | 4/1977 | Bushnell, Jr. | |
| 4,331,219 | A | | 5/1982 | Suzuki | |
| 4,519,262 | A | | 5/1985 | Le et al. | |
| 4,540,329 | A | | 9/1985 | Martin | |
| 4,674,938 | A | * | 6/1987 | Van Stokes et al. | 187/207 X |
| 4,976,336 | A | | 12/1990 | Curran | |
| 5,015,146 | A | | 5/1991 | Barnes et al. | |
| 5,119,906 | A | * | 6/1992 | Kondratuk | 187/363 X |
| 5,497,854 | A | * | 3/1996 | Fang | 187/213 |
| 5,971,108 | A | | 10/1999 | Yu | |

FOREIGN PATENT DOCUMENTS

| | | | | |
|---|---|---|---|---|
| FR | 2 326 376 | | 4/1977 | |
| FR | 2 479 791 | | 10/1981 | |
| FR | 2 487 803 | | 2/1982 | |
| FR | 2 501 177 | | 9/1982 | |
| FR | 2 576 298 | | 7/1986 | |
| GB | 885599 A | * | 12/1961 | 187/208 |
| GB | 2003116 A | * | 3/1979 | 187/207 |
| GB | 1 587 361 | | 4/1981 | |

* cited by examiner

*Primary Examiner*—Eileen D. Lillis
*Assistant Examiner*—Thuy V. Tran
(74) *Attorney, Agent, or Firm*—Theresa Fritz Camoriano; Guillermo E. Camoriano

(57) ABSTRACT

A cable lift includes a platform supported on posts and raised and lowered by cables. Yoke ends support the platform on the posts by means of dogs which project into openings in latch plates on said posts. The dogs are retracted in order to lower the platform. In the event of a slack cable condition, a slack cable actuator moves the dogs back into contact with the latch plates.

4 Claims, 7 Drawing Sheets

LOCK MECHANISM FOR LIFT

This application claims priority from U.S. Provisional Application Ser. No. 60/175,470, filed Jan. 11, 2000, which is hereby incorporated by reference.

BACKGROUND OF THE INVENTION

The present invention relates to lifts, and, in particular, to an improved locking mechanism for a lift. Many different types of lifts are known, and many different locking mechanisms have been used. In the case of lifts that are operated with cables, which includes cables, chains, ropes, or other flexible means, it is desirable to provide a mechanism that provides a mechanical lock that will support the load if the cables fail. Such locks have been provided in the past, but they were separate from the normal support mechanism of the lift and required periodic inspection and adjustment.

SUMMARY OF THE INVENTION

The present invention provides a lock that takes advantage of the existing structure of the lift and engages the same structure that holds the lift up during normal operation to support the load in the event of a cable failure. This avoids the need for a separate locking mechanism for cable failure; it is much easier to maintain than the prior art; and it does not interfere with the normal operation of the lift.

Figure 1:
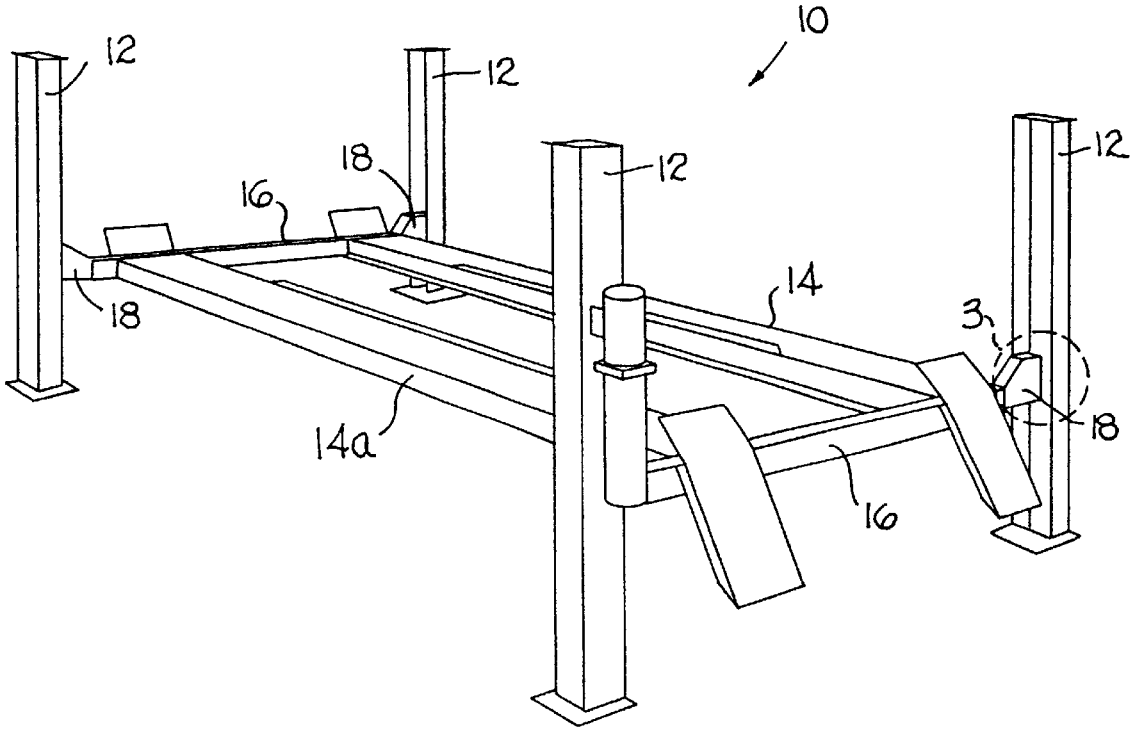
FIG. 1 is a perspective view of a lift made in accordance with the present invention.
Figure 2:
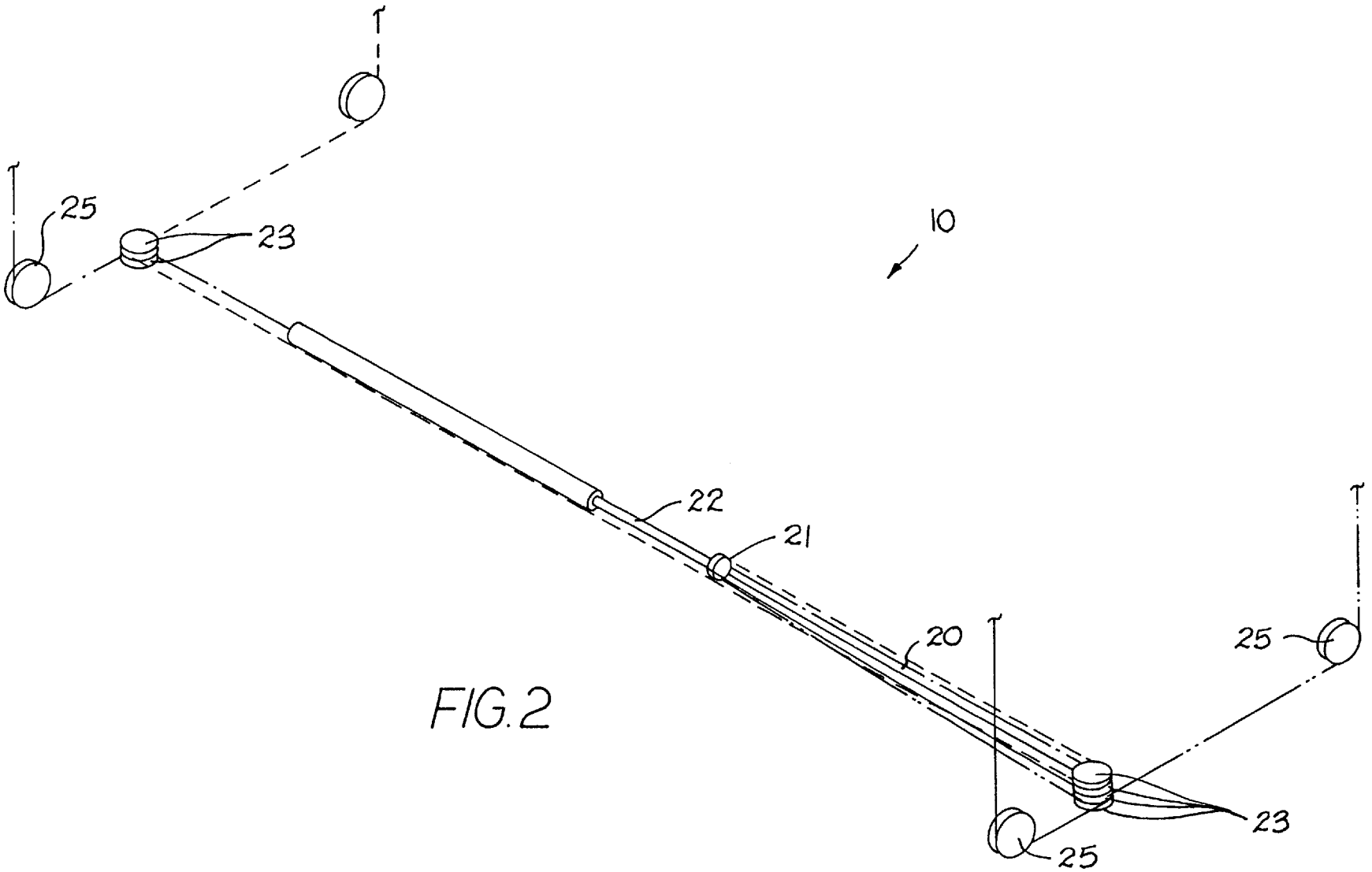
FIG. 2 is a schematic of the cable system that operates the lift of FIG. 1.
Figure 3:
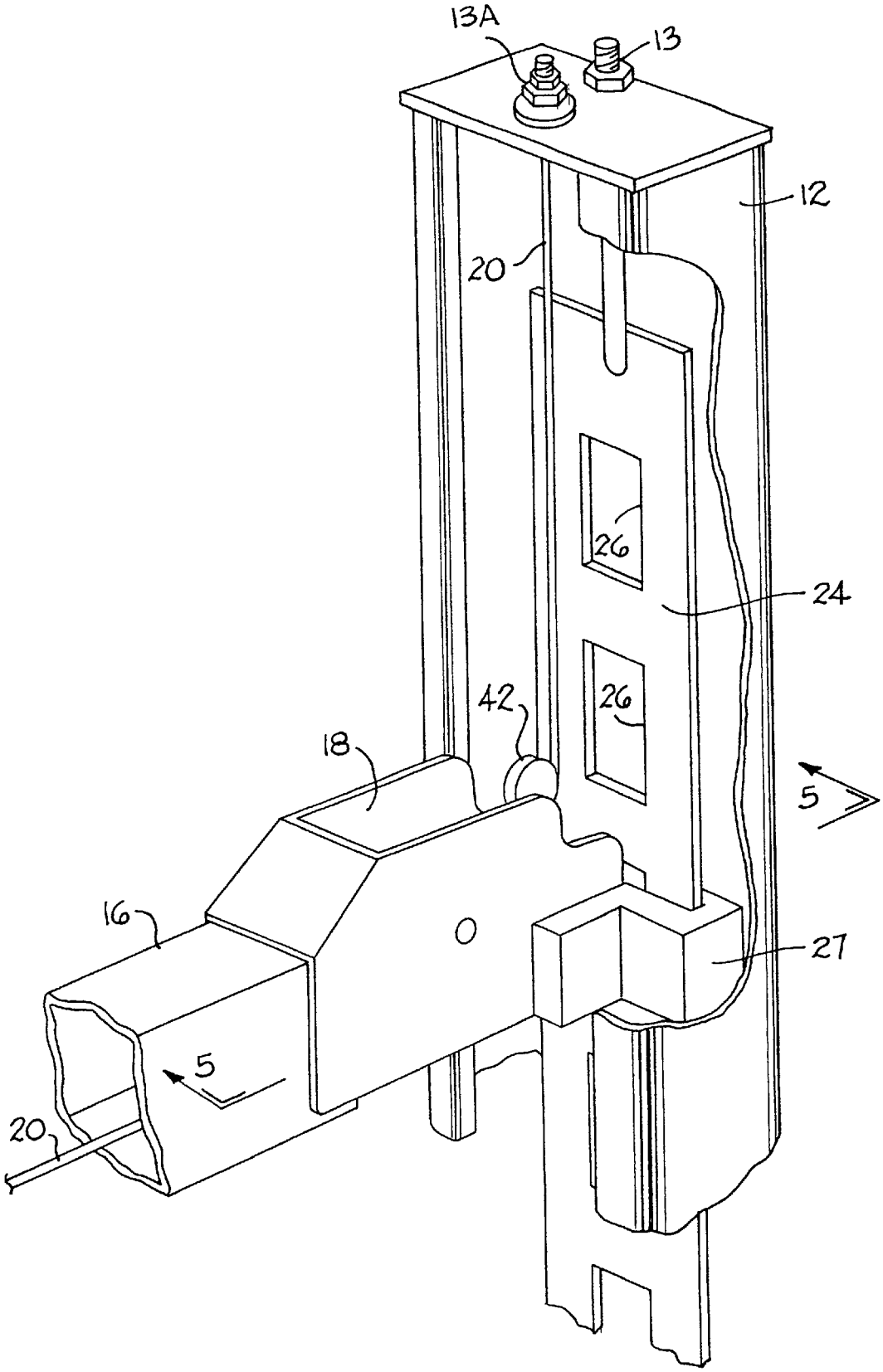
FIG. 3 is an enlarged, broken-away, perspective view of one of the posts and one of the yoke ends of the lift of FIG. 1.
Figure 4:
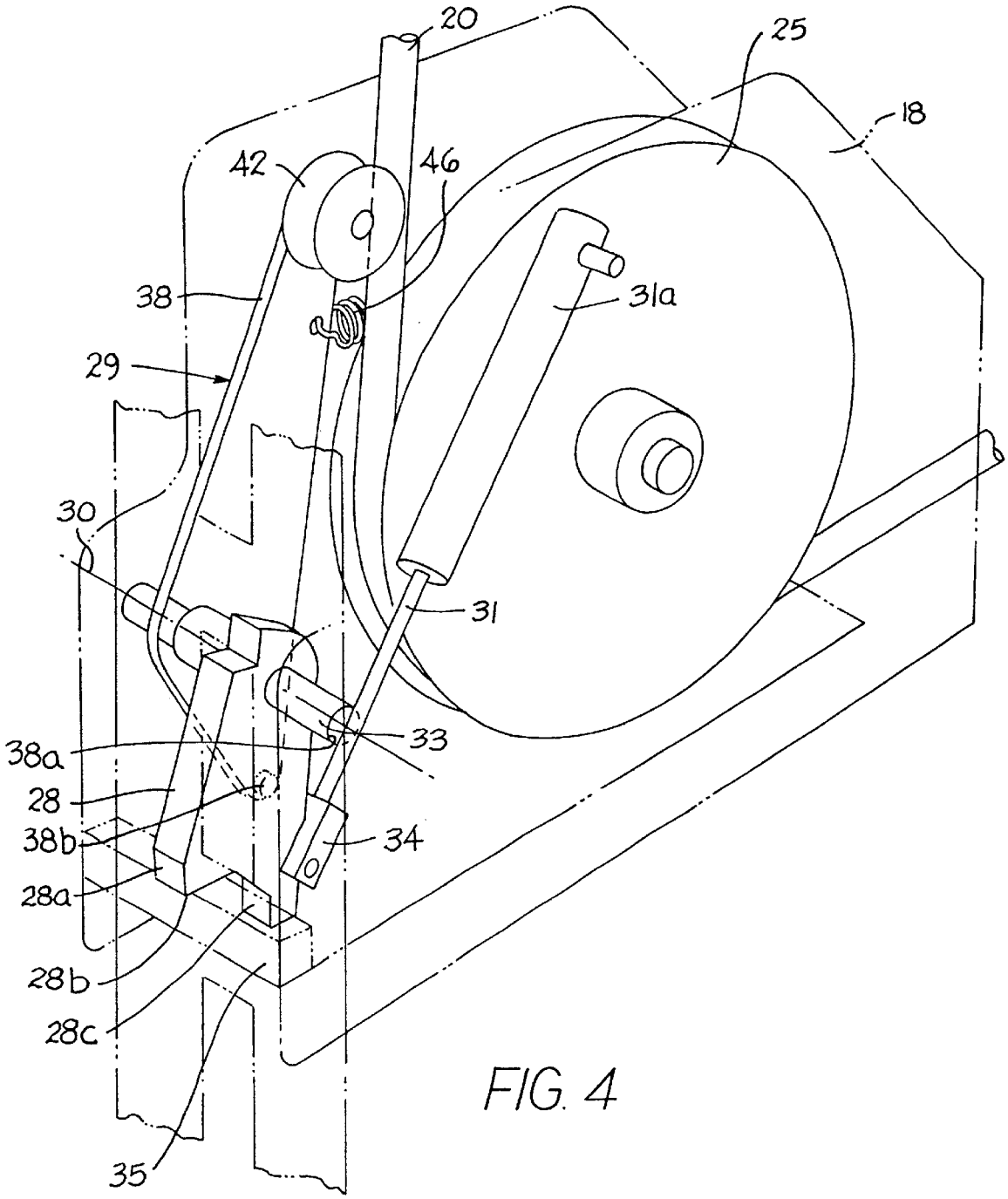
FIG. 4 is a broken away perspective view of the locking mechanism of the post and yoke of FIG. 3, with the ladder of the post and the yoke end shown in phantom.

DESCRIPTION OF THE PREFERRED EMBODIMENTS:

FIGS. 1–3 show the general layout of a four-post lift 10 made in accordance with the present invention. The lift 10 includes four posts 12 and a platform 14 that is supported on the posts 12. The platform 14 includes left and right runways 14a and two left-to-right horizontal yokes 16. At both ends of each yoke 16 are yoke ends 18, which support the platform 14 on the posts 12.

The four yoke ends 18, which carry the platform 14, are lifted and lowered on four cables 20. Each yoke end 18 carries a main sheave 25, which receives its respective cable

20. One end of each cable 20 is secured to the top of its respective post 12, as shown in FIG. 3, and the length of each cable 20 can be adjusted by adjusting the nut 13A. The other end of each cable is mounted onto a bracket 21 (See FIG. 2), which is fixed to the end of a movable arm or piston rod 22. The cables extend around sheaves 23, which move up and down with the platform 14, and they extend around the main sheaves 25 mounted on the yoke ends 18. As the movable arm or piston rod 22 retracts, it effectively reduces the length of the cables 20 between the main sheaves 25 and the tops of the posts 12. This causes the platform 14 to move upwardly. As the movable arm or piston rod 22 extends, it effectively increases the length of the cables 20 between the main sheaves 25 and the tops of the posts 12, causing the platform to move downwardly.

On each post 12 is fixed a latch ladder bar 24. The position of the latch ladder bar 24 relative to the post 12 can be adjusted by adjusting the nut 13, shown best in FIG. 3. The latch ladder bar has equally-spaced openings 26, which are used to support the platform 14 at various heights on the posts 12, as will be described below. Each yoke end 18 carries a pair of sliders 27, which wrap around the sides of the latch ladder bar 24, thus maintaining the relationship of the latch ladder bar 24 and the yoke end 18.

FIGS. 3–7A show the mechanism that supports each yoke end 18 on its respective latch ladder bar 24. The mechanism includes a pivoting latch dog 28, which mounts onto the yoke end 18 by means of a pivot pin 33, which defines a pivot axis 30. The dog 28 includes a protrusion 28*a*, which has a slanted, ramp-shaped top surface and a horizontal bottom surface 28*b*. When the protrusion 28*a* projects through one of the openings 26 in the latch ladder bar 24, the bottom surface 28*b* of the protrusion 28*a* serves as a stop to prevent the platform 14 from moving downwardly relative to the latch ladder bar 24. The dog 28 is pivotably connected to a piston rod 31, which serves as a dog-retracting actuator, extending and retracting the dog 28.

Figure 5A:
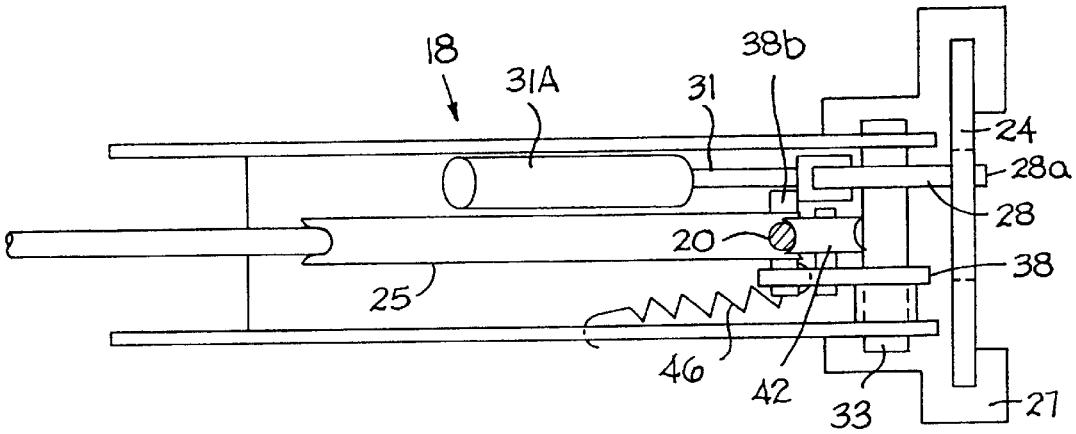
FIG. 5A is a top view of the locking mechanism of FIG. 5.
Figure 5:
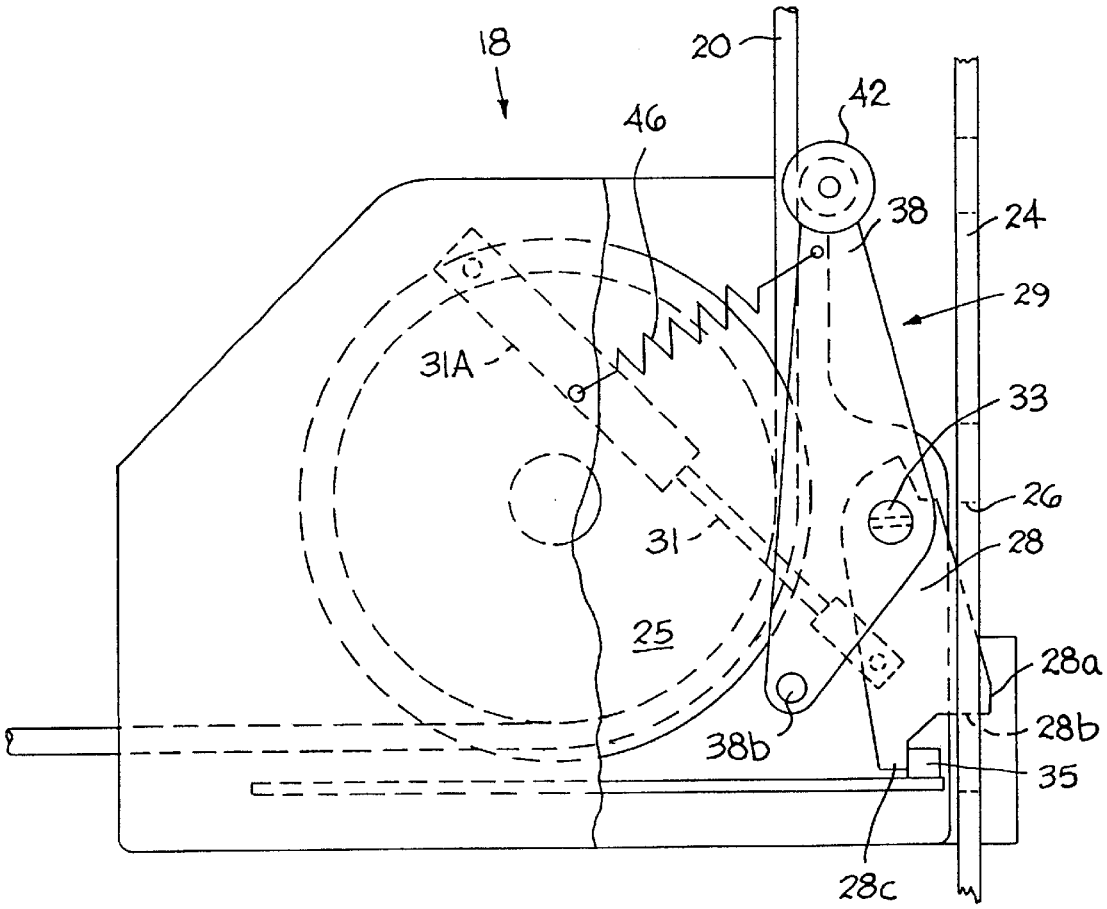
FIG. 5 is a side view of the locking mechanism of FIG. 4 in a normal lifting position.
Figure 6A:
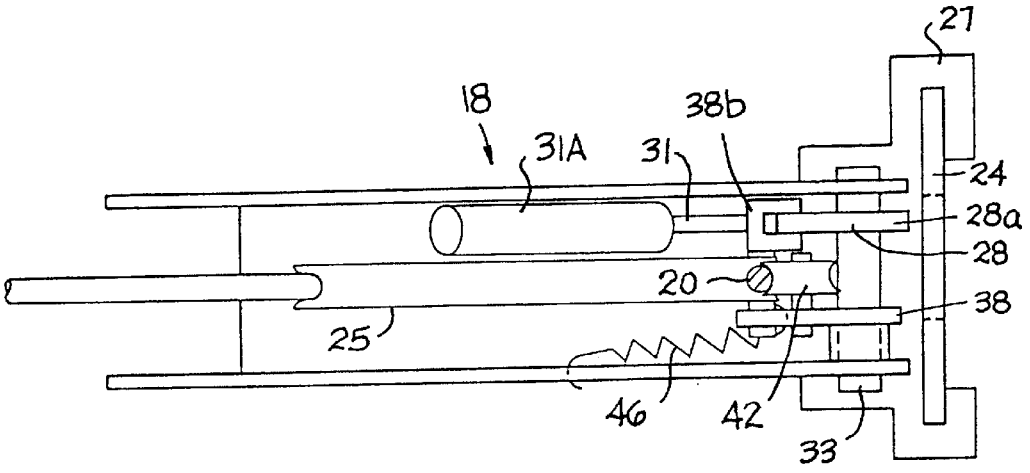
FIG. 6A is a top view of the locking mechanism of FIG. 6.
Figure 6:
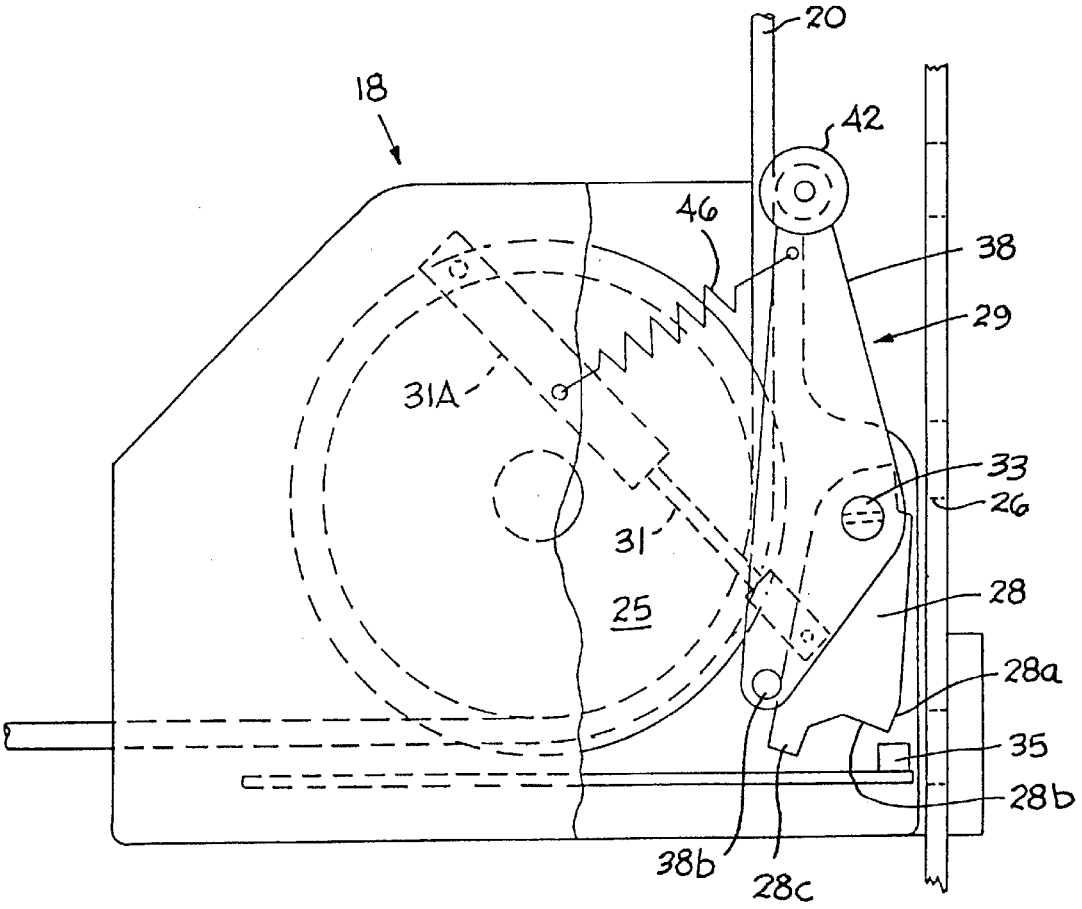
FIG. 6 is a side view of the locking mechanism of FIG. 4 in a retracted position for lowering the lift.

The piston rod 31 exerts a force to extend the dog during normal lifting operations, as shown in FIGS. 5 and 5A, placing the dog 28 in its extended position as the platform 14 is being raised by the cables 20. Actuation of the control system causes the piston rod 31 to exert a force to retract the dog 28 during normal descent of the lift, as shown in FIGS. 6 and 6A.

When the dog is in the normal lifting position of FIG. 5, and the platform 14 is moving upwardly relative to the latch ladder bar 24, the slanted ramp-shaped top surface of the protrusion 28*a* causes the dog 28 to pivot out of the latch ladder bar 24 as it passes each rung of the latch ladder bar 24, and the piston rod 31 pushes the dog 28 back toward the latch ladder bar 24, causing the protrusion 28*a* to enter each window 26 of the latch ladder bar 24. A downwardly-projecting portion 28*c* of the dog 28 contacts a stop 35 on the yoke end 18 to prevent the dog 28 from pivoting too far in the direction of the latch ladder bar 24.

As the dog 28 reaches each respective opening 26 in the latch ladder bar 24, it extends into the opening 26, providing a stop for the platform 14. The dogs 28 may be used to support the weight of the platform 14 on the posts 12 at any rung position by resting on the rungs of the latch ladder bars 24.

In order to lower the platform 14, actuation of the control system causes the cylinder 31 a to retract the piston rod 31, which retracts the dog 28 so that it does not contact the latch ladder bar 24. This position is shown in FIGS. 6 and 6A. When the dog 28 is retracted in this manner for lowering the platform 14, there is a need to provide a mechanism to stop the yoke end 18 from further lowering if a cable 20 were to lose tension. In the event of a slack cable, this device uses a slack cable actuator 29 to push the dog 28 back into contact with the latch ladder bar 24, so the same dog 28 serves as a stop both during normal operation of the lift and in the event of a slack cable.

Figure 7A:
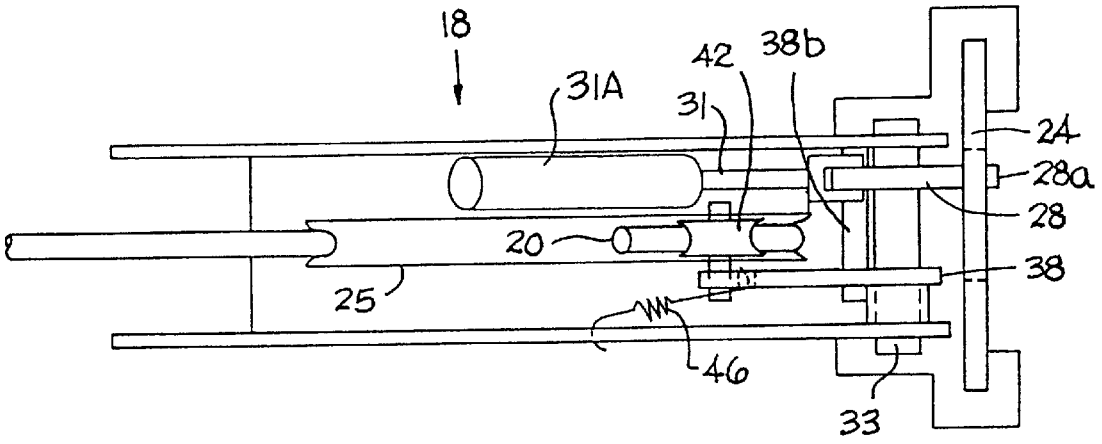
FIG. 7A is a top view of the locking mechanism of FIG. 7.
Figure 7:
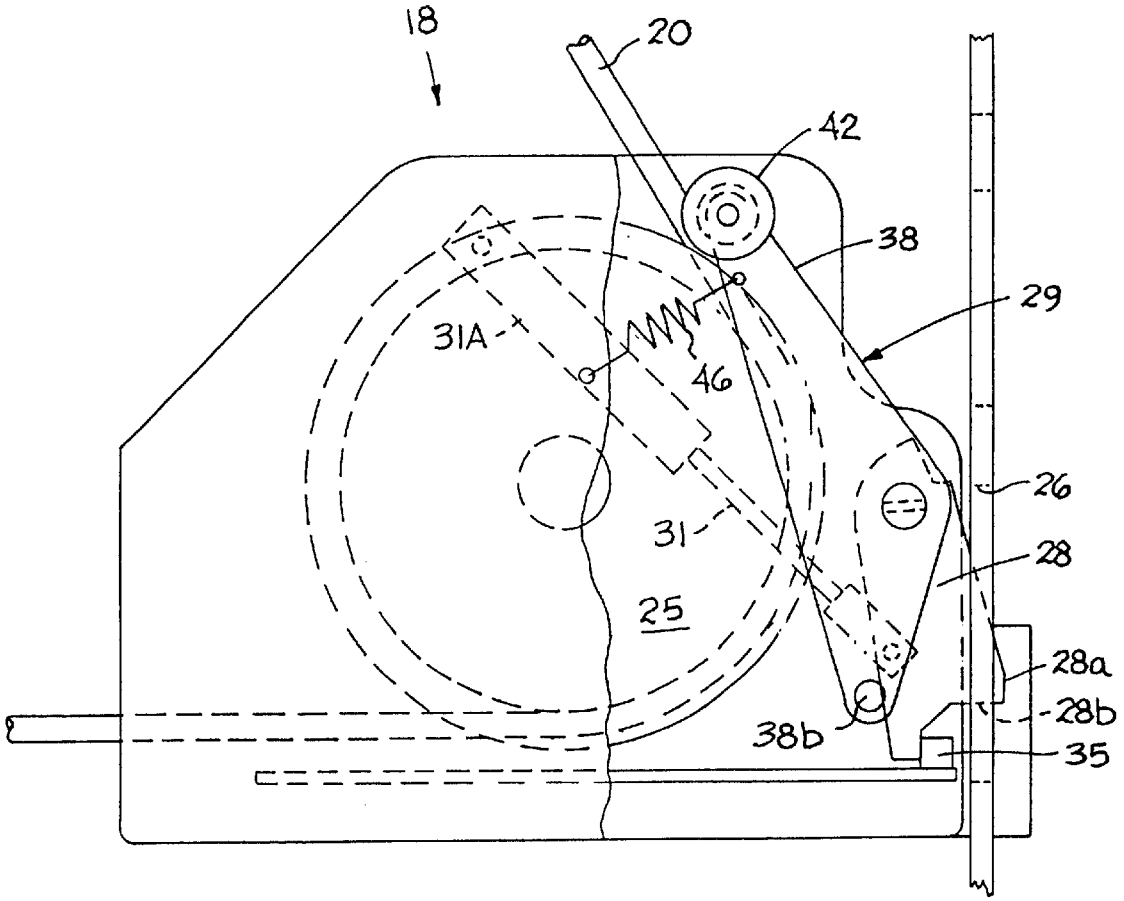
FIG. 7 is a side view of the locking mechanism of FIG. 4 in a locked position under slack cable conditions.

The slack cable actuator includes a pivot arm 38, which defines an opening 38*a* that receives the same pivot pin 33 as the dog 28, so that the pivot arm 38 pivots about the same axis 30 as the dog 28 and is mounted adjacent to the dog 28 on that pivot pin 33. A small sheave 42 is rotatably mounted on the upper portion of the pivot arm 38, and there is a horizontal projection 38*b* at the lower portion of the pivot arm 38. On the upper portion of the arm 38 is also mounted a biasing spring 46, the other end of which is mounted to the yoke end 18, so that the spring 46 biases the pivot arm 38 in a counter-clockwise direction, when viewed from the position of FIG. 5. More than one spring may be used, if desired. As long as the cable 20, which is received in the sheave 42 is taut, the cable 20 keeps the actuator pivot arm 38 retracted, so that it does not push the dog 28 out into the latch ladder bar opening 26. However, if the cable 20 becomes slack, as shown in FIGS. 7 and 7A, the biasing spring 46 pivots the actuator pivot arm 38 counter-clockwise, and the horizontal projection 38*b* of the actuator pivot arm 38 contacts the back side of the dog 28, overriding the piston 31, and pushing the dog 28 out into the opening 26 in the latch ladder bar 24.

Thus, if the cable 20 were to become slack at any time, even when the dog 28 is retracted by its respective piston rod 31, the actuator pivot arm 38 would pivot, contacting the lower portion of the dog 28, overriding the piston 31, and pushing the dog 28 out into a latch ladder bar opening 26 to support the yoke end 18 on the latch ladder bar 24. This same mechanism preferably is provided at all yoke ends 18.

The force of the spring 46 and the force of the retracted piston 31 which retracts the dog 28 must be selected so that the spring force is great enough to overcome the retracted piston force and will override the controller which is retracting the piston 31, thereby causing the piston rod 31 to extend even when the control system is causing the piston rod 31 to be retracted.

This arrangement takes advantage of the same dogs 28 to support the weight of the platform 14 both during normal operating conditions and in the event of a slack cable condition. This eliminates the need for a second set of dogs, simplifies the mechanism, and makes maintenance much easier than in prior designs.

It will be obvious to those skilled in the art that modifications may be made to the system described above without departing from the scope of the present invention.

What is claimed is:

1. A lift, comprising:

a plurality of substantially vertical posts, each including a latch plate defining a plurality of vertically-spaced openings;

a lift platform, including a plurality of yoke ends, each of said yoke ends supported on its respective post;

a plurality of lift cables, one of said lift cables supporting each yoke end;

each of said yoke ends including a main sheave, which receives its respective lift cable for raising and lowering the yoke end relative to its respective post;

a dog, which pivots into the openings of the latch plate as the yoke end moves upwardly relative to its respective post;

a first actuator, which extends and retracts the dog during normal, taut cable operating conditions; and a slack cable actuator which extends said dog in response to a slack cable condition, even when the first actuator has retracted the dog;

each of said slack cable actuators including a pivot arm having a secondary sheave in contact with its respective lift cable, which, when the lift cable is taut, biases said pivot arm in a first direction; and a spring, which biases said pivot arm in a second direction; wherein, when the lift cable is taut, the lift cable acting against the secondary sheave maintains said pivot arm in a normal operating position, and, when the lift cable is slack, the spring rotates said pivot arm to a locking position; wherein the rotation of said pivot arm to the locking position mechanically extends said dog; and wherein each of said slack cable actuators operates independently of the other slack cable actuators.

2. A lift as recited in claim 1, wherein said pivot arm directly contacts said dog in order to move the dog to the extended position.

3. A lift as recited in claim 2, wherein said spring extends between said pivot arm and its respective yoke end.

4. A lift as recited in claim 1, wherein said first actuator includes a fluid-operated piston-cylinder arrangement, and wherein said spring overcomes the force of said first actuator in a slack cable condition.

* * * * *